US007637127B2

(12) United States Patent
Mills et al.

(10) Patent No.: US 7,637,127 B2
(45) Date of Patent: Dec. 29, 2009

(54) DUAL PARTICULATE FILTER FOR DRY CLEANING EQUIPMENT

(75) Inventors: Robert Thomas Mills, Louisville, KY (US); Venkataraman Rachakonda, Farmington, MI (US); Timothy Dale Worthington, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 757 days.

(21) Appl. No.: 11/204,432

(22) Filed: Aug. 16, 2005

(65) Prior Publication Data

US 2007/0039358 A1 Feb. 22, 2007

(51) Int. Cl.
*D06F 33/06* (2006.01)

(52) U.S. Cl. ..... 68/12.02; 210/433.1; 210/455; 210/459; 68/18 F

(58) Field of Classification Search ..... 68/12.08, 68/18 F; 210/433.1, 455, 459
See application file for complete search history.

(56) References Cited

U.S. PATENT DOCUMENTS

| | | | | | |
|---|---|---|---|---|---|
| 3,978,694 | A | * | 9/1976 | Hughes et al. | 68/18 R |
| 4,266,412 | A | | 5/1981 | Merenda | |
| 4,513,590 | A | * | 4/1985 | Fine | 68/18 C |
| 4,769,921 | A | | 9/1988 | Kabakov et al. | |
| 4,793,938 | A | | 12/1988 | Dayton | |
| 4,954,222 | A | | 9/1990 | Durr et al. | |
| 5,069,755 | A | | 12/1991 | Durr et al. | |
| 5,457,270 | A | | 10/1995 | Hildebrand et al. | |
| 5,510,029 | A | * | 4/1996 | Benian | 210/333.01 |
| 5,565,097 | A | | 10/1996 | Hayday | |
| 5,637,212 | A | | 6/1997 | Kim | |

* cited by examiner

*Primary Examiner*—Frankie L Stinson
*Assistant Examiner*—Samuel A Waldbaum
(74) *Attorney, Agent, or Firm*—George L. Rideout, Esq.; Armstrong Teasdale LLP

(57) ABSTRACT

A dual particulate filter assembly includes a filter frame and a first filter element and a second filter element mounted in the filter frame. The first filter element is configured to remove particulates from a first medium, and the second filter element is configured to remove particulates from a second medium different from the first medium.

12 Claims, 5 Drawing Sheets

DUAL PARTICULATE FILTER FOR DRY CLEANING EQUIPMENT

BACKGROUND OF THE INVENTION

This invention relates generally to dry cleaning machines, and more particularly, to a dual particulate filter for a dry cleaning machine.

At least some known dry cleaning machines include a cabinet that houses an outer tub for containing a quantity of dry cleaning fluid, a perforated clothes basket within the tub, and a storage tank for storing the dry cleaning fluid. A drive and motor assembly is mounted underneath the stationary outer tub to rotate the basket within the tub. Generally, the dry cleaning machine performs a cleaning cycle followed by a spin cycle and a drying cycle.

In at least one cleaning cycle, the clothes are saturated with cleaning fluid and tumbled in an amount of cleaning fluid. The dry cleaning fluid dissolves certain fluid soluble soils. The clothes are tumbled to dislodge some insoluble soils and generally to increase the effectiveness of the cleaning process. Due to the cost of the dry cleaning fluid, the fluid is not discarded, rather, the dry cleaning fluid is filtered to remove particulates, such as lint, cleaned, and returned to the storage tank for reuse.

In a typical drying cycle, the cleaning fluid is drained from the tub and fluid remaining in the clothes after spinning is evaporated from the clothes to dry the clothes. The evaporated cleaning fluid is condensed and liquefied and returned to the storage tank. A dry filter is generally provided to remove air borne particulates such as lint or fabric fibers that come from the clothes during drying. Air is not exhausted from the dry cleaning machine during the drying cycle to facilitate the recapture of the evaporated fluid. Further, the dry cleaning machine is generally sealed during operation to inhibit the emission of cleaning fluid vapors, some of which could be harmful, into the home.

While the dry cleaning machine gives the consumer the capability to clean some fabrics for which washing in water could be harmful, the dry cleaning machine has certain detriments. For instance, there are separate wet and dry filters that the consumer must remember to clean to prevent inefficient operation of the dry cleaning machine.

BRIEF DESCRIPTION OF THE INVENTION

In one aspect, a dual particulate filter assembly for a dry cleaning machine is provided. The dual particulate filter assembly includes a filter frame and a first filter element and a second filter element mounted in the filter frame. The first filter element is configured to remove particulates from a first medium, and the second filter element is configured to remove particulates from a second medium different from the first medium.

In another aspect, a dry cleaning fluid recovery system for a dry cleaning machine is provided. The dry cleaning fluid recovery system includes a housing having a liquid inlet and an air inlet. A dual particulate filter assembly is slidably received in the housing. A spray nozzle delivers liquid dry cleaning fluid to the dual particulate filter assembly. A dehumidifying assembly removes vaporized fluid from air within the dry cleaning machine.

In another aspect, a dry cleaning machine is provided. The dry cleaning machine includes a tub for holding clothes to be cleaned and a door providing sealed access to the tub. A dry cleaning fluid recovery system is in flow communication with the tub. The dry cleaning fluid recovery system includes a housing having a liquid fluid inlet and an air inlet. A dual particulate filter assembly is slidably received in the housing.

A spray nozzle delivers liquid dry cleaning fluid from the liquid fluid inlet to the dual particulate filter assembly. A dehumidifying assembly is provided for removing vaporized fluid from air within the dry cleaning machine. A fan is provided for circulating air through the drum and through the dry cleaning fluid recovery system.

DETAILED DESCRIPTION OF THE INVENTION

Figure 1:
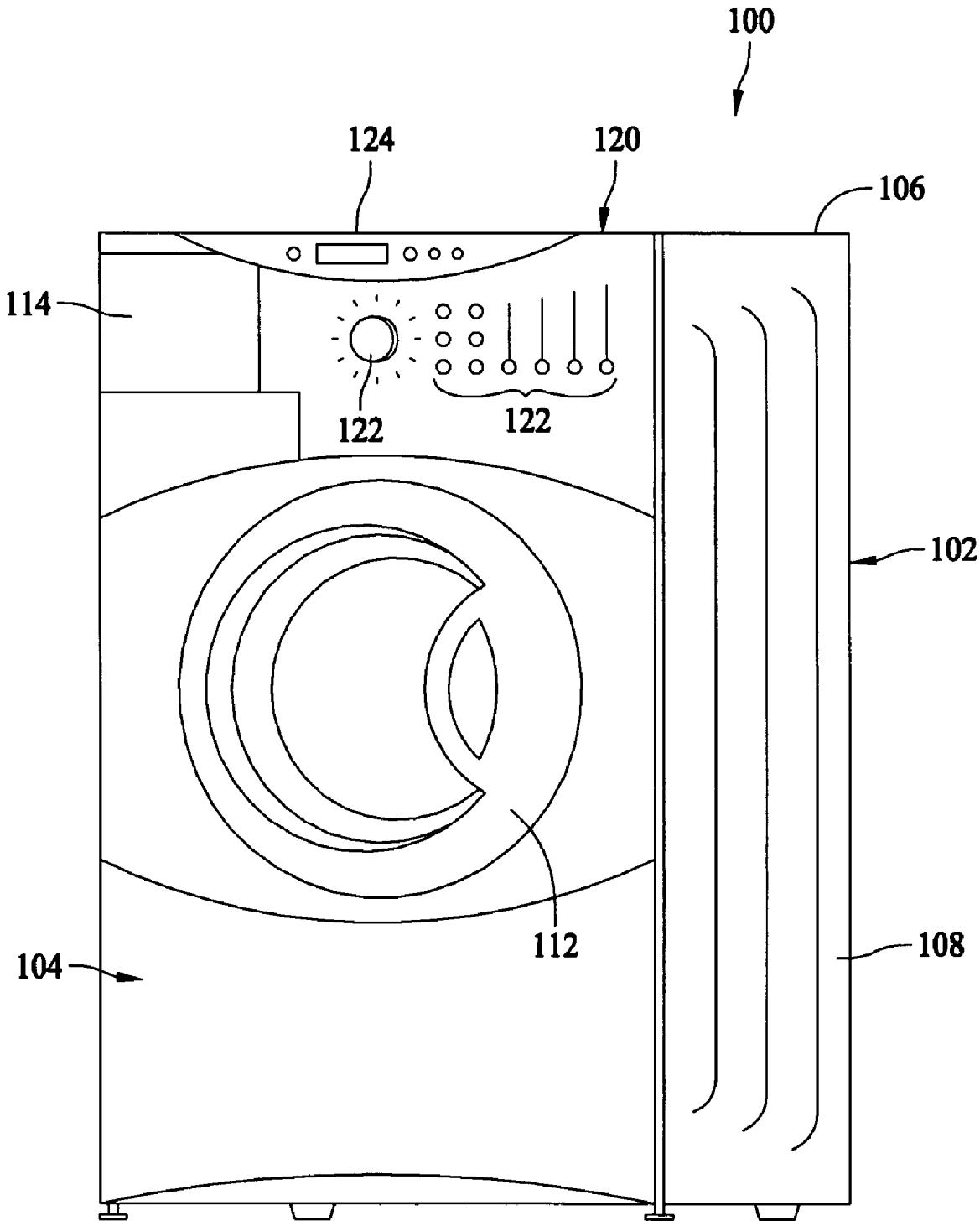
FIG. 1 is a perspective view of an exemplary dry cleaning machine.

FIG. 1 is a perspective view of an exemplary dry cleaning machine 100. Dry cleaning machine 100 includes a cabinet 102 having a front panel 104, a top panel 106, and side panels 108. A door 112 is mounted to the front panel 104 and is rotatable about a hinge (not shown) between an open position (not shown) facilitating access to a basket (not shown) in the interior of the dry cleaning machine 100 that holds a clothes load, and a closed position (as shown in FIG. 1) forming a substantially sealed enclosure over the basket. Front panel 104 also includes a cover 114 that covers a dual lint filter user interface (see FIG. 2). A control panel 120 including a plurality of input selectors 122 is coupled to an upper portion of front panel 104. Control panel 120 and input selectors 122 collectively form a user interface for operator selection of machine cycles and features, and, in one embodiment, a display section 124 indicates selected features, machine status, and other items of interest to users. As illustrated in FIG. 1, dry cleaning machine 100 is a horizontal axis dry cleaning machine. It is contemplated that the benefits of the invention accrue to other types of dry cleaning machines, including, but not limited to, vertical axis machines.

Figure 2:
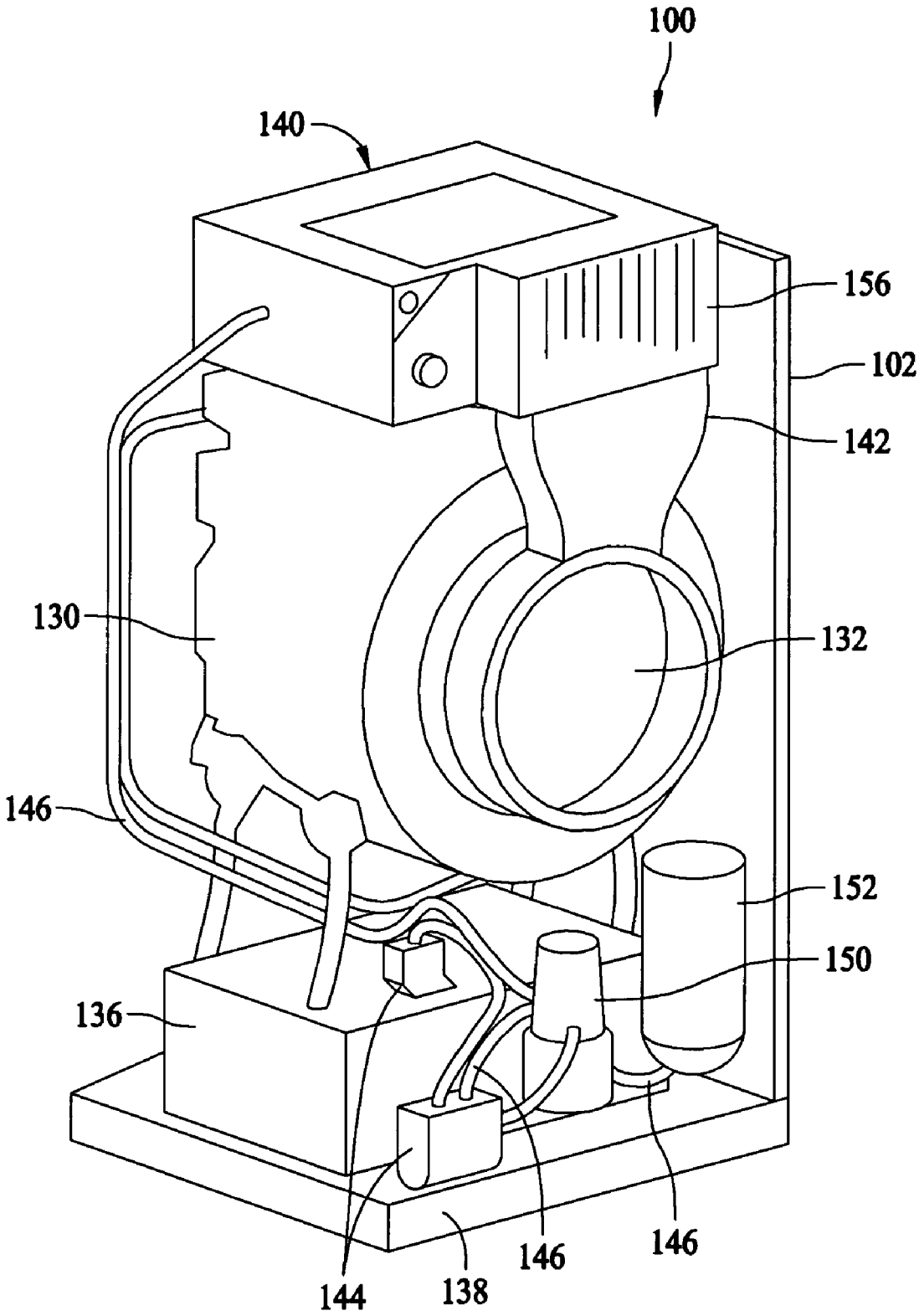
FIG. 2 is a perspective cutaway view of the dry cleaning machine shown in FIG. 1 with the cabinet partially removed.

FIG. 2 is a perspective cutaway view of dry cleaning machine 100 with the cabinet 102 partially removed. Dry cleaning machine 100 includes a tub 130 that has an opening 132 which provides access to the clothes basket (not shown) that is rotatably mounted within tub 130. A storage tank 136 for dry cleaning fluid is located on a cabinet base platform 138 beneath tub 130. Dry cleaning fluid, due to its cost is recycled after clothes are cleaned and stored in storage tank 136 for reuse. A fluid recovery system 140 is positioned above tub 130 to recover liquid and evaporated dry cleaning fluid as will be described. A return duct 142 returns filtered air from fluid recovery system 140 to tub 130. A plurality of pumps 144 are located beneath tub 130 to deliver dry cleaning fluid from storage tank 136 to various components of the dry cleaning machine, including tub 130 and to return recovered fluid to storage tank 136. A plurality of fluid lines 146 extend between pumps 144, storage tank 136, tub 130, fluid recovery system 140, as well as a water separator 150 and a canister filter 152, and other components.

Water separator 150 remove water from the dry cleaning fluid. Water is not normally used in the dry cleaning process, however, water may be present in dry cleaning machine 100 from humidity in the air or a wet garment in the clothes load. Canister filter 152 is part of a multi-stage filtration process, the first stage of which occurs in fluid recovery system 140.

Operation of dry cleaning machine 100 is controlled by a main controller 156 which is operatively coupled to the user interface input located on front panel 104 (FIG. 1) of dry cleaning machine 100 for user manipulation to select dry cleaning machine cycles and features. In response to user manipulation of the user interface input, main controller 156 operates the various components of dry cleaning machine 100 to execute selected machine cycles and features.

Figure 3:
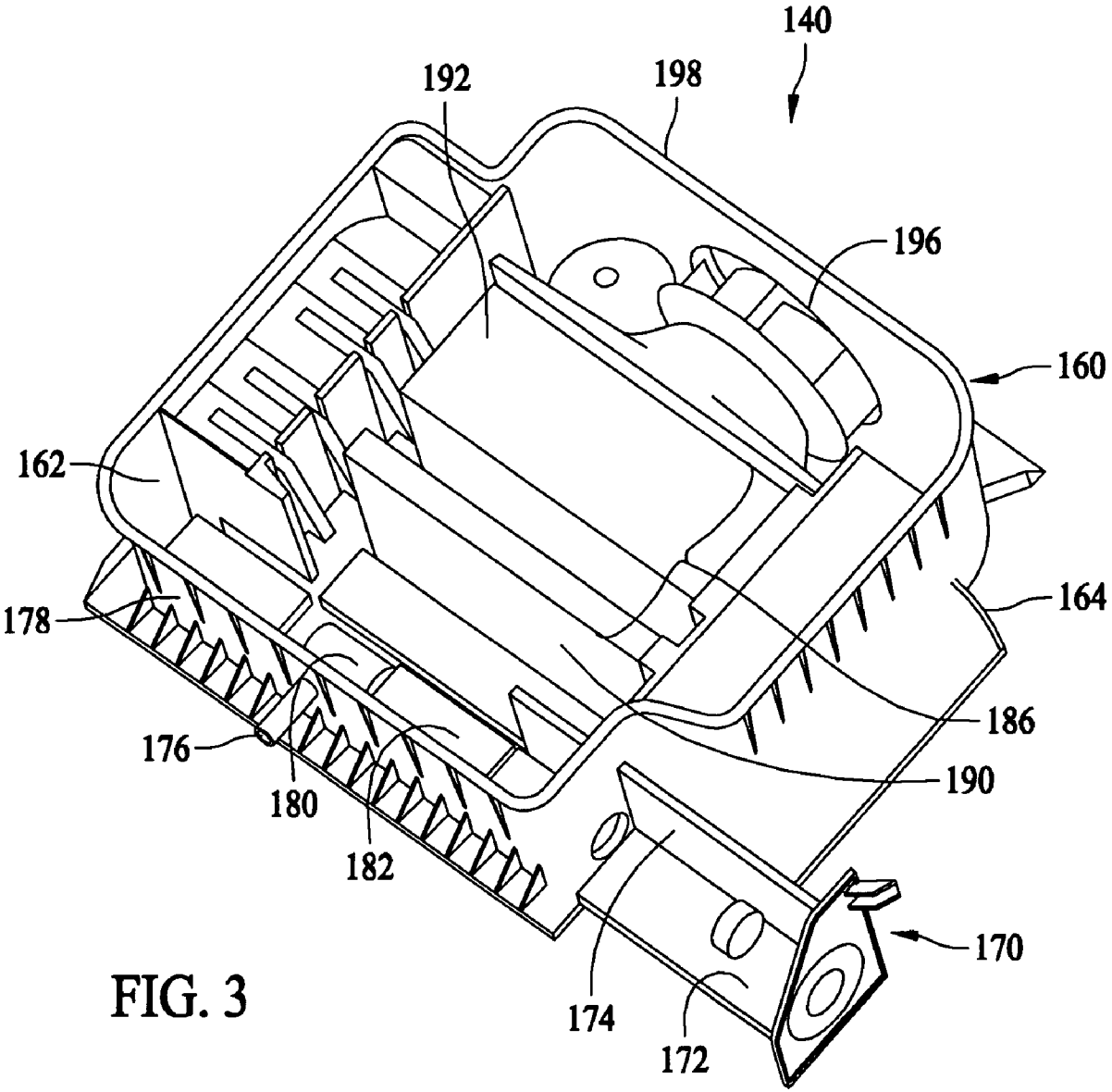
FIG. 3 is perspective view of an exemplary dry cleaning fluid recovery system.

FIG. 3 is perspective view of dry cleaning fluid recovery system 140. Fluid recovery system 140 includes a housing 160 that defines an air inlet 162 and an air outlet 164. As used herein, air is generally intended to encompass any mixture of gases that may be found within a dry cleaning machine, including liquids in a vapor state, including, but not limited to vaporized dry cleaning fluid and water vapor. A dual particulate filter assembly 170 is slidably received in housing 160. Air inlet 162 admits air into fluid recovery system 140 and directs the air toward filter assembly 170. As illustrated in FIG. 3, filter assembly 170 is partially removed from housing 160. Filter assembly 170 includes a wet or liquid filter element 172 and a dry or gas filter element 174. More specifically, dry filter element 174 filters air circulated over the clothes during the drying process. A fluid inlet line 176 extends through a side wall 178 of housing 160. A nozzle or baffle 180 is attached to an interior side of side wall 178 at the entry of fluid inlet line 176. Nozzle 180 directs incoming fluid downward onto wet filter element 172 of filter assembly 170. Air entering housing 160 through air inlet 162 is directed to flow along filter assembly 170 and through dry filter element 174. A sump 182 is formed in a bottom of housing 160 in an area located beneath filter assembly 170 when filter assembly 170 is installed in housing 160.

Fluid recovery system 140 further includes a dehumidifying assembly 186 that has an evaporator 190, and a condenser 192. Evaporator 186 is in flow communication with filter assembly 170 and receives air exiting dry filter element 174. Condenser 192 is also in flow communication with filter assembly 170 and with evaporator 190 and receives air exiting evaporator 190. A fan 196 draws air from tub 130 (FIG. 2), and through dry filter element 174, evaporator 190, and condenser 192. After passing through condenser 192, the air flows through air outlet 164 and is returned to tub 130. Fan 196 establishes a flow path through dry cleaning machine 100 through tub 130 FIG. 2), fluid recovery system inlet 162, through filter assembly 170 and dehumidifying system 186, and through outlet 164 which directs air back to tub 130. A gasket 198 is provided along an upper edge of housing 160 for sealing between housing 160 and top panel 106 (FIG. 1) of cabinet 102 (FIG. 1).

Figure 4:
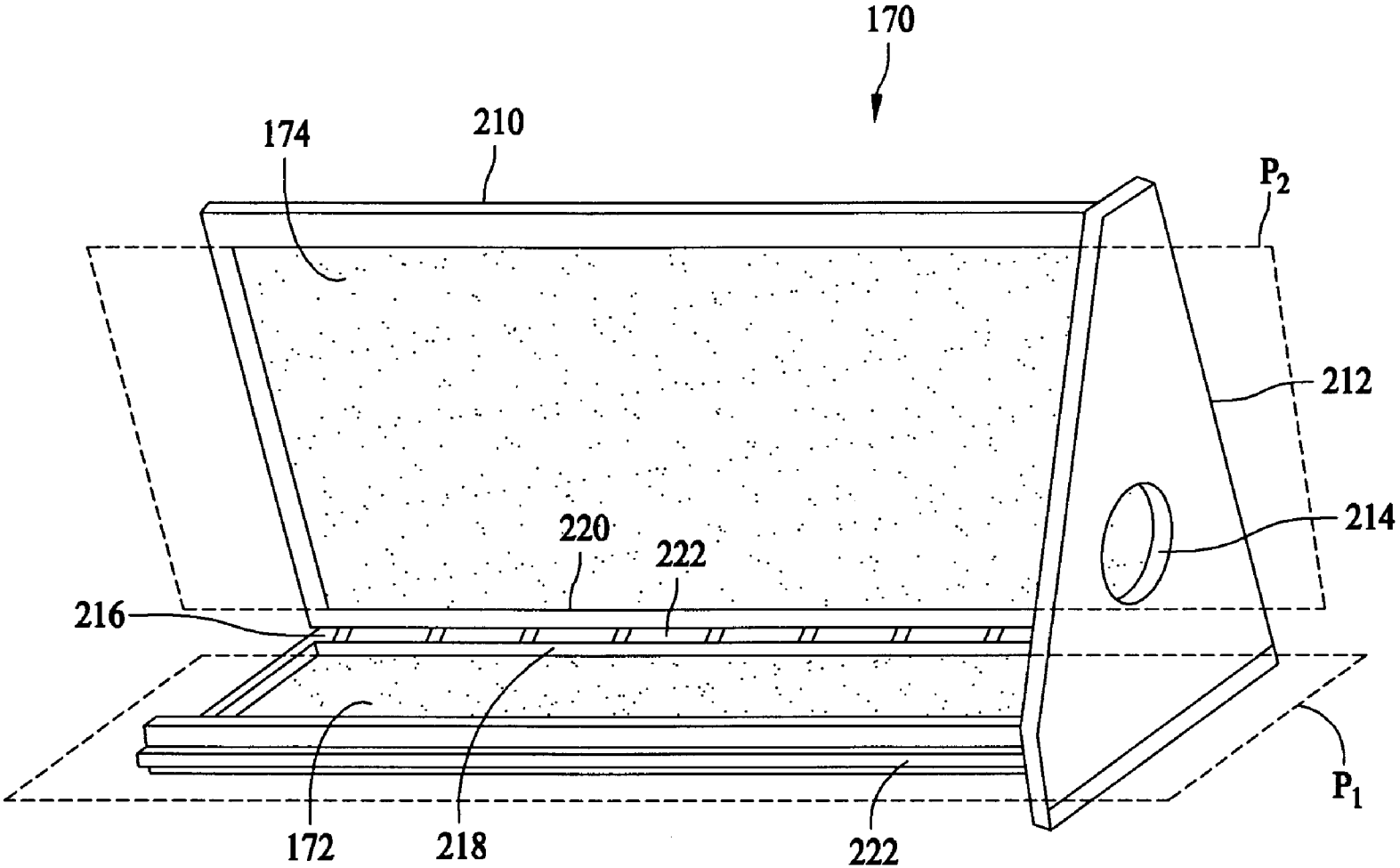
FIG. 4 is a perspective view of an exemplary dual particulate filter.

FIG. 4 is a perspective view of dual particulate filter assembly 170. Filter assembly 170 includes a frame 210 in which there is mounted a first filter element 172 and a second filter element 174. First filter element 172 is configured to remove particulates from a first medium while second filter element 174 is configured to remove particulates from a second medium that is different from the first medium. More specifically, first filter element 172 is configured to filter particulates, such as lint, from a liquid medium such as liquid dry cleaning fluid, and second filter element 174 is configured to filter particulates, such as lint, from a gaseous medium, such as air. Thus, first filter element 172 may be referred to as a wet filter element, while second filter element 174 may be referred to as a dry filter element.

Filter elements 172 and 174 extend from an end plate 212 that includes a hole 214 for receiving a knob for tightening filter assembly 170 against sealing gaskets as will be described. First or wet filter element 172 is formed in a plane $P_1$ and extends from end plate 212. Similarly, second or dry filter element 174 is formed in a plane $P_2$ and extends from end plate 214 in substantially the same direction as first filter element 172. Additionally, plane $P_1$ and $P_2$ intersect one another. In an exemplary embodiment, planes $P_1$ and $P_2$ are substantially perpendicular to one another. It is to be understood however, that planes $P_1$ and $P_2$ may intersect at other than a right angle in other embodiments. A divider portion 216 of frame 210 spaces apart adjacent edges 218 and 220 of filter elements 172 and 174, respectively. In some embodiments, divider 216 may include a plurality of slots 222. In an exemplary embodiment, frame 210 includes a guide rail 224 formed on an edge proximate wet filter element 174. Guide rail 224 facilitates ease of removal and replacement of filter assembly 170 in housing 160. In an exemplary embodiment, filter assembly 170 exhibits an L shape. It is to be understood, however that in other embodiments, other geometries may also be used.

Wet filter element 172, is configured to filter particulates, such as lint from the clothes load, from liquid dry cleaning fluid drained from tub 130 after the completion of a cleaning cycle. Filtration of lint from the liquid dry cleaning fluid is the first of several liquid filtering and cleaning steps that includes separating water from the dry cleaning fluid and filtering the dry cleaning fluid through a carbon and clay bed filter, prior to returning the dry cleaning fluid to storage tank 136.

Dry filter element 174 is configured to filter particulates, such as lint from the clothes load that is carried in air from tub 130 during the drying process. Wet filter element 172 includes a mesh screen having a first mesh size and dry filter element 174 includes a mesh screen having a second mesh size that may be different than the first mesh size, where the mesh size refers to a size of the openings in the mesh. In an exemplary embodiment, a finer mesh, e.g. having smaller openings, is used for filtering particulates from the air in dry filter element 174, while a coarser mesh, e.g. having larger openings, is used for filtering particulates from the liquid dry cleaning fluid in wet filter element 172. In other embodiments, the mesh sizes of both wet filter element 172 and dry filter element 174 may be varied as necessary to achieve desired filtration goals. In one exemplary embodiment, dry filter element 174 includes an eighty micron mesh screen.

Figure 5:
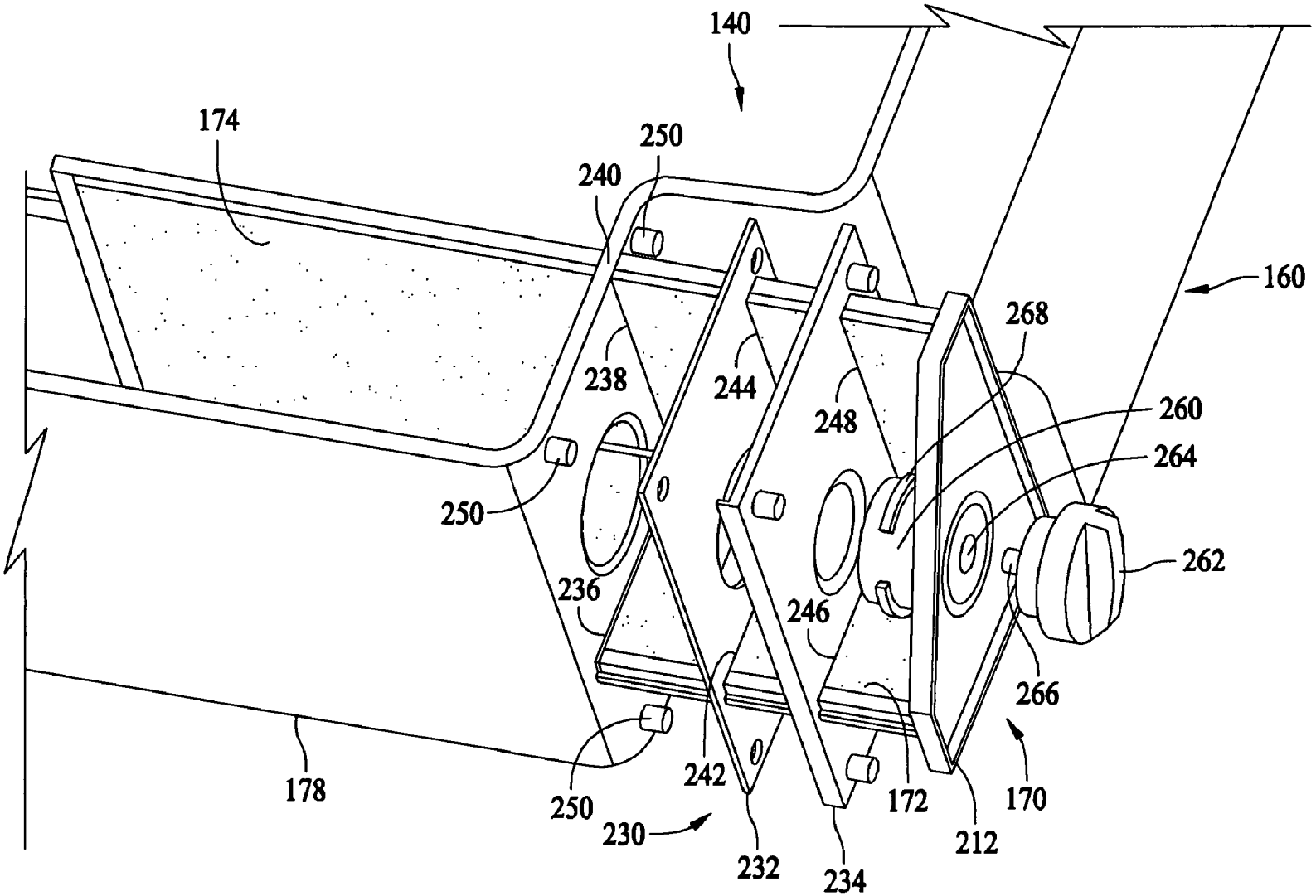
FIG. 5 is an exploded view of an exemplary retention system for a dual particulate filter assembly.

FIG. 5 is an exploded view of an exemplary retention system 230 for dual particulate filter assembly 170. Retention system 230 includes a gasket 232 and an inner plate 234. Filter assembly 170 is slidably received in housing 160 through slots 236 and 238 formed in a housing wall 240. Similarly, filter assembly 170 is slidably received in gasket 232 through slots 242 and 244, and in inner plate 234 through slots 246 and 248. Alignment pins 250 facilitate positioning gasket 232 and inner plate 234 against housing wall 240.

Retention system 230 also includes an inner knob 260 and an outer knob 262. Inner knob 260 includes a threaded opening 264 that receives a threaded extension 266 on outer knob 262 for threaded attachment of outer knob 262 to inner knob 260. Lands 268 are provided on an outer surface of inner knob 260 that engage an inner side of housing wall 240 such that rotation of outer knob 262 locks filter assembly 170 in place and also compresses sealing gasket 232 to prevent air leakage from fluid recovery system 140. More specifically, sealing gasket 232 seal endplate 212 against housing 160 to prevent air leakage from filter assembly 170 and fluid recovery system 140.

In use, filter assembly 170 is slidably received in housing 160. Filter assembly 170 is locked in place and fluid recovery system 140 is sealed using outer knob 262 which is threadedly coupled with inner knob 260. When filter assembly 170 is installed and sealed, the drying cycle of dry cleaning machine 100 can be executed. The drying cycle begins with draining dry cleaning fluid from tub 130 (FIG. 2). The drained fluid is delivered to fluid recovery system 140 where nozzle 180 directs liquid dry cleaning fluid downward onto wet filter element 172 to remove liquid borne particulates. Fluid passing through wet filter element 172 flows into sump 182 for return, after further filtration, to storage tank 136.

After draining the liquid dry cleaning fluid, the clothes are tumbled while air is passed over the clothes. Air from tub 130 is delivered to air inlet 162 of fluid recovery system 140. Air inters inlet 162 and is directed toward filter assembly 170 in a direction substantially parallel to filter planes $P_1$ and $P_2$. Movement of the air in a direction parallel to plane $P_1$, facilitates drying of wet filter element 172 and facilitates cleaning of wet filter element 172 at the end of the drying cycle. Fan 196 draws air through dry filter element 174 to remove air borne particulates. The air then flows through evaporator 190 and condenser 192 of dehumidifying assembly 186 (FIG. 3). Evaporator 190 condenses vaporized cleaning fluid from the air. The liquid dry cleaning fluid from evaporator 190 flows into sump 182 and is directed to the remainder of the liquid filtering and cleaning steps. The condenser 192 condenses a system refrigerant in a condensing tube (not shown) within the condenser 192 to a liquid state. Air exits fluid recovery system 140 through air outlet 164 (FIG. 3) and is returned to drum 130 (FIG. 2). Recirculation of the air from drum 130 to fluid recovery system 140 and back to drum 130 continues for the duration of the drying cycle.

The sections of dry cleaning machine 100 that come into contact with dry cleaning fluid, including filter assembly 170 and fluid recovery system 140, are sealed during operation to inhibit the emission of cleaning fluid vapors into the home. After the clothes are cleaned and dried, dry cleaning machine 100 stops and filter assembly 170 can be removed for cleaning by unscrewing outer knob 262. Filter assembly 170 is conveniently accessible from the front of dry cleaning machine 100 and when removed both wet filter 172 and dry filter 174 may be cleaned in one cleaning operation. Thus, the complexity and inconvenience of having two separately located wet and dry filter elements are avoided.

The above described apparatus provides a dual particulate filter assembly 170 that includes a wet filter element 172 and a dry filter element 174 in one filtration unit. Wet filter element 172 removes liquid borne particulates from liquid dry cleaning fluid drained from the tank 130. Dry filter element 174 removes air borne particulates during the drying process. Wet filter element 172 is also dried during the drying process. Dual particulate filter 170 eliminates the need for the consumer to remove and clean two separate filter elements. Dual particulate filter assembly 170 is easily accessible from the front of the dry cleaning machine 100.

While the invention has been described in terms of various specific embodiments, those skilled in the art will recognize that the invention can be practiced with modification within the spirit and scope of the claims.

What is claimed is:

1. A dry cleaning fluid recovery system for a dry cleaning machine, said dry cleaning fluid recovery system comprising:

a housing including a liquid fluid inlet and an air inlet;

a dual particulate filter assembly slidably received in said housing, said dual particulate filter assembly comprising:

a filter frame;

a first filter element mounted in said filter frame, said first filter element configured to remove particulates from a first medium; and a second filter element mounted in said filter frame, said second filter element having a feed means independent of the first filter element, said second filter element configured to remove particulates from a second medium different from said first medium;

a spray nozzle delivering liquid dry cleaning fluid from said liquid fluid inlet to said dual particulate filter assembly; and a dehumidifying assembly for removing vaporized fluid from air within the dry cleaning machine.

2. A dry cleaning fluid recovery system in accordance with claim 1 further including a fan for drawing air and evaporated fluid through said housing.

3. A dry cleaning fluid recovery system in accordance with claim 2 further including an air outlet configured to deliver air from said fluid recovery system to a tub in the dry cleaning machine.

4. A dry cleaning fluid recovery system in accordance with claim 1 wherein said first filter element defines a plurality of first openings having a first size and said second filter element defines a plurality of second openings having a second size different than said first size.

5. A dry cleaning fluid recovery system in accordance with claim 4 wherein said first medium includes a gas and said second medium includes a liquid.

6. A dry cleaning fluid recovery system in accordance with claim 4 wherein said dual particulate filter assembly further includes a gasket for sealing said end plate against said housing.

7. A dry cleaning fluid recovery system in accordance with claim 4 wherein said first and second filter elements are formed in respective planes and extend in substantially the same direction from said end plate.

8. A dry cleaning fluid recovery system in accordance with claim 7 wherein said air inlet admits air into said dry cleaning fluid recovery system and directing the air in a direction substantially parallel to said planes of said filter elements.

9. A dry cleaning fluid recovery system in accordance with claim 1 wherein said dehumidifying assembly comprises:

an evaporator in flow communication with said dual particulate filter assembly and receiving air exiting said dual particulate filter assembly; and a condenser in flow communication with said dual particulate filter assembly and said evaporator, said condenser receiving air exiting said evaporator filter assembly.

10. A dry cleaning fluid recovery system in accordance with claim 1 wherein said housing includes a sump formed therein beneath said dual particulate filter assembly.

11. A dry cleaning fluid recovery system in accordance with claim 1 further including a gasket configured for sealing said fluid recovery system against a top of a cabinet.

12. A dry cleaning machine comprising:

a tub for holding clothes to be cleaned;

a door providing sealed access to said tub; and a dry cleaning fluid recovery system in flow communication with said tub, said dry cleaning fluid recovery system comprising:

a housing including a liquid fluid inlet and an air inlet;

a dual particulate filter assembly slidably received in said housing, said dual particulate filter assembly comprising:

a filter frame;

a first filter element mounted in said filter frame, said first filter element configured to remove particulates from a first medium; and a second filter element mounted in said filter frame, said second filter element having a feed means independent of the first filter element, said second filter element configured to remove particulates from a second medium different from said first medium;

a spray nozzle delivering liquid dry cleaning fluid from said liquid fluid inlet to said dual particulate filter assembly; and a dehumidifying assembly for removing vaporized fluid from air within the dry cleaning machine; and a fan for circulating air through said drum and said dry cleaning fluid recovery system.

* * * * *